United States Patent [19]

Takeo et al.

[11] Patent Number: 4,674,230

[45] Date of Patent: Jun. 23, 1987

[54] APPARATUS FOR HOLDING A MOTOR VEHICLE DOOR IN A DESIRED OPENING DEGREE THEREOF

[75] Inventors: Yuji Takeo, Toyokawa; Tomohisa Yoshimi, Gamagori; Yoshio Shinoda, Aichi; Ken Nomura, Okazaki, all of Japan

[73] Assignee: Nippondenso Co., Ltd., Kariya, Japan

[21] Appl. No.: 830,133

[22] Filed: Feb. 18, 1986

[30] Foreign Application Priority Data

Feb. 20, 1985 [JP] Japan ..... 60-33519
Feb. 20, 1985 [JP] Japan ..... 60-33520

[51] Int. Cl.[4] ..... E05F 15/10

[52] U.S. Cl. ..... 49/32; 49/31; 49/28

[58] Field of Search ..... 49/31, 32, 26, 27, 28

[56] References Cited

U.S. PATENT DOCUMENTS 1,278,145 9/1918 Haviland ..... 49/32
3,553,890 8/1968 Stretton ..... 49/32
4,458,446 7/1984 Mochida et al. ..... 49/358 X

FOREIGN PATENT DOCUMENTS 57-126717 8/1982 Japan .
57-191121 11/1982 Japan .
57-198119 12/1982 Japan .
57-198118 12/1982 Japan .
606796 8/1948 United Kingdom ..... 49/32

*Primary Examiner*—Kenneth Downey
*Attorney, Agent, or Firm*—Cushman, Darby & Cushman

[57] ABSTRACT

An apparatus for holding a motor vehicle door in a desired opening degree thereof comprises a touch sensor provided on the door for detecting whether or not the touch sensor is touched by an operator, an engaging member pivotally mounted at one end thereof onto a vehicle body, a pair of piston-cylinder assemblies each including a friction member which is driven by pneumatic power to clamp the engaging member, and a control unit for receiving signals from the touch sensor and delivering commands to a power supply unit to drive the piston-cylinder assemblies upon receipt of the signal indicating that the touch sensor is touched by the operator.

12 Claims, 7 Drawing Figures

APPARATUS FOR HOLDING A MOTOR VEHICLE DOOR IN A DESIRED OPENING DEGREE THEREOF

FIELD OF THE INVENTION AND RELATED ART STATEMENT

The present invention relates to an apparatus for holding a motor vehicle door open to a position.

There is known a safety device for a door, wherein as long as the vehicle driver or passenger, i.e. the operator assumes an abnormal seating attitude, the door opening or closing motion is prohibited even if the door opening or closing switch is operated, as exemplified by U.S. Pat. No. 4,422,521.

However, this known arrangement has a functional disadvantage. When vehicle is parked in a narrow parking lot or on slopping ground, it is difficult to maintain a desired door opening degree in a desired one. For example, when the operator gets in or out of the vehicle in a narrow parking lot, the door hits against another parked vehicle because the door automatically continues its opening or closing motion until a predetermined door opening degree is achieved unless the operator assumes an abnormal seating attitude.

Furthermore, in the above mentioned art, there is employed an electric motor as driving means to effect an automatic opening or closing of the door. However, since a door opening or closing mechanism for converting a rotational motion of the motor into a reciprocating movement of a door operating member can not afford to enlarge the stroke thereof due to spatial restriction, there may be involved the disadvantages that the mechanism becomes inevitably complicate when it is required to hold the door in a desired open degree.

SUMMARY OF THE INVENTION

Accordingly, an object of the present invention is to provide an apparatus for holding a motor vehicle door in a desired opening degree, by which the door is operable when the operator wants to open or close the door and the door can be held in a desired opening degree.

To this end, the present invention provides a new arrangement for holding a motor vehicle door in a desired opening degree sensor means are provided on the door for detecting whether or not it is being touched by an operator. Holding means associated with the door is provided for holding the door open to a desired opening degree. Control means is provided for receiving signals from said sensor means and delivering commands to said holding means. The control means outputs commands to the holding means to make it inoperative upon receipt of the signal from said sensor means indicating that the sensor means is touched by the operator. The control means outputs commands to the holding means to operate it upon receipt of the signal from said sensor means indicating that the sensor means is not touched by the operator.

According to the present invention, as long as the operator touches on a part of the door in which the sensor means is provided, the operator can open or close the door manually over the full range door opening degree the control means judges the operator's intention of opening or closing the door and outputs commands to the door holding means to release the door so that the operator can position it manually.

On the contrary, when the operator releases his hand from the sensor means, the door is held in an instant opening degree because the control means outputs the commands to the door holding means to operate it to hold the door. [For example, during that the passenger conducts the opening or closing operation of the door, at the moment the operator releases him from the door, the door is held in the instant opening degree.]

The present invention has several functional advantages. A passenger will not be caught in the door. The door will not hit a parked vehicle. Also safety is improved significantly. This becomes important in case of door opening or closing operation under strong windy weather, or of getting on or off the vehicle when the vehicle is parked on a slope or in a narrow parking lot.

DETAILED DESCRIPTION OF THE PREFERRED EMBODIMENTS

The invention will be described hereinafter in details with reference to the accompanying drawings.

Figure 1:
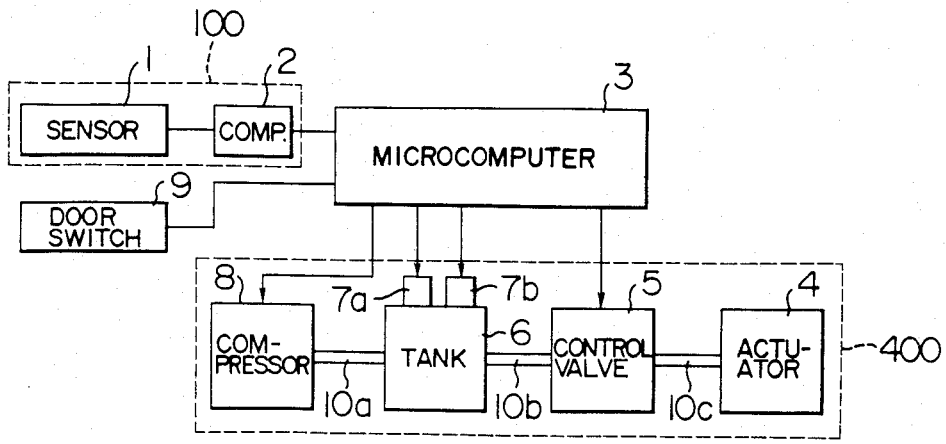
FIG. 1 is a block diagram showing one embodiment of the present invention.
Figure 2:
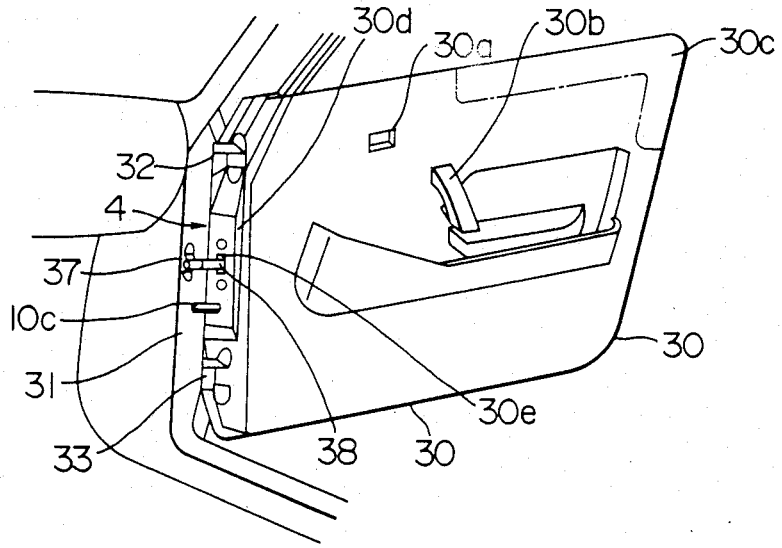
FIG. 2 is a perspective view showing the door to which the embodiment shown in FIG. 1 is applied.
Figure 3:
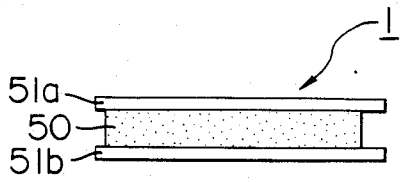
FIG. 3 is a schematic view showing the sensor shown in FIG. 1.

In FIG. 1 a sensor 1 detects whether or not it is touched by the operator. The sensor 1 is disposed in a part of a door on which the operator would usually touch when opening or closing of the door. The sensor 1 is preferably mounted on an inner knob 30*a* of the door 30, or on a handle of an arm rest 30*b* or a door trim portion 30*c* as shown in FIG. 2. Alternatively, the sensor 1 may be mounted on an external knob or a door sash of the door 30 (not shown), which the operator who is outside the vehicle would likely touch. Though the sensor 1 can have various structural configuration in accordance with the mounting manner thereof, one typical configuration is shown in detail in FIG. 3. The sensor 1 includes a pressure sensitive rubber sheet 50 sandwiched between electrodes 51*a* and 51*b*, which gradually decreases the resistance thereof, from an insulation state to a conductive state, in response to the magnitude of pressure to be applied thereto. This type of touch sensor is configured to cover an extended area of the door on which the operator may touch.

The change of resistance in the sensor 1 is transmitted to a comparison circuit 2 and transformed into "H" (high level) signal or "L" (low level) signal. When the operator does not touch sensor 1, the pressure sensitive rubber sheet 50 is in the insulation state and the comparison circuit 2 outputs the "L" signal. However, when the operator touches on the sensor 1, the resistance of the pressure sensitive rubber sheet 50 is reduced and the comparison circuit 2 outputs the "H" signal. The sensor 1 and the comparison circuit 2 constitute sensor means 100. The signal from the sensor means 100 is coupled to the microcomputer 3 which functions as a control means. In this embodiment, the microcomputer 3 receives not only the signal from the sensor means 100 but a signal from a door switch 9 which detects an opening condition of the door 30. The microcomputer 3 includes a memory unit for temporary storing the signals from the sensor means 100 and the door switch 9, a memory unit for storing a control program which is flow charted in FIG. 6, and a control unit for executing the control program and for determining command signals. The command signal from the microcomputer 3 operates a holding means 400 which employs a pneumatic actuator 4. The holding means 400 includes an electric compressor 8 for compressing air, a compressed air storage tank 6, a compressed air flow control valve 5 (referred hereinunder to as "control valve"), the actuator 4 for holding the door 30, which is driven by the compressed air supplied from the tank 6 through the control valve 5, and air conduits 10*a*, 10*b* and 10*c* connecting among the compressor 8, the tank 6, the control valve 5 and the actuator 4.

The tank 6 is provided with a low pressure switch 7*a* and a high pressure switch 7*b*. When an interior pressure within the tank 6 is lowered below a low predetermined value (for example, $3.9\times10^5$ Pa), the low pressure switch 7*a* is closed and outputs a signal indicating that he interior pressure in the tank 6 is low. When the interior pressure within the tank 6 exceeds a high predetermined value (for example, $4.9\times10^5$ Pa), the high pressure switch 7*b* is opened and outputs a signal indicating that the interior pressure in the tank is high. The control valve 5 is a three ports solenoid valve. When energized, the control valve 5 makes the conduit 10*b* communicate with the conduit 10*c*. When disenergized, the control valve 5 makes the conduit 10*c* communicate with the atmosphere.

The actuator 4 will be now explained in detail.

As shown in FIG. 2, the door 30 is pivotably mounted onto a pillar 31 through a pair of hinge members 32, 33. The actuator 4 is disposed within an interior of the hollow door 30 and is mounted on an inner surface of a door cover 30*d* facing to the pillar 31. The door cover 30*d* is provided at a center portion thereof with an opening 30*e*. A smoothly curved plate-shaped check arm 38 is pivotally mounted at one end thereof to the pillar 31 through a bracket 37. The other end of the arm 38 is inserted into the door 30 through the opening 30*e*. The check arm 38 varies its stroke length (a length of an exposed portion of the arm 38 outwardly of the door 30) according to the opening degree of the door 30. The greater becomes the opening degree of the door, the greater becomes the stroke length. The conduit 10*c* is provided below the check arm 38 so as to supply the compressed air to the actuator 4 through the control valve 5 which is mounted in the vehicle body.

Figure 4:
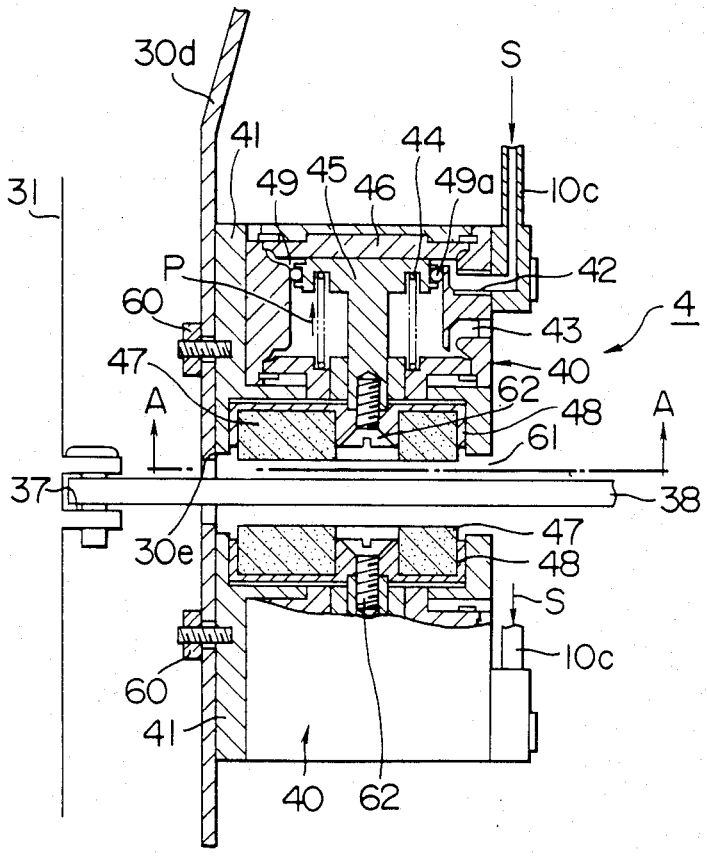
FIG. 4 is a sectional view showing the actuator shown in FIG. 1.
Figure 5:
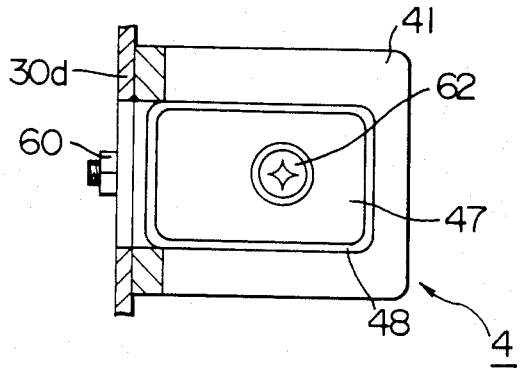
FIG. 5 is a bottom view taken along the line A—A of FIG. 4.

Referring to FIGS. 4 and 5, the actuator 4 includes a pair of cylinders 40, 40 between which a space 61 is formed for permitting the check arm 38 to reciprocate therethrough. The cylinder 40 is housed within a holder 41 which is mounted on the door cover 30*d* by means of nut 60. The cylinder 40 is provided with an inlet port 42 through which the compressed air is introduced from the conduit 10*c* along a direction of arrow S, and an outlet port 43 through which the interior of the cylinder 40 communicates with the atmosphere. The cylinder 40 is further provided with a spring 44 which is pre-compressed in a direction of arrow P and a piston 45 one end surface of which is urged against a head cover 46 by means of the spring force of the spring 44. The piston 45 carries at the other end thereof a holder member 48 which is secured to the piston 45 by means of a screw 62. Each holder member 48 houses therein a friction member 47 so that one friction member 47 cooperates with the other friction member to clamp the check arm 38 therebetween. The friction member 47 is made, for example, by molding powder resins and asbestos under heat and pressure. The piston 45 is provided at one axial end periphery thereof with an O-ring 49*a* for air-tightly defining a working chamber 49.

Figure 6:
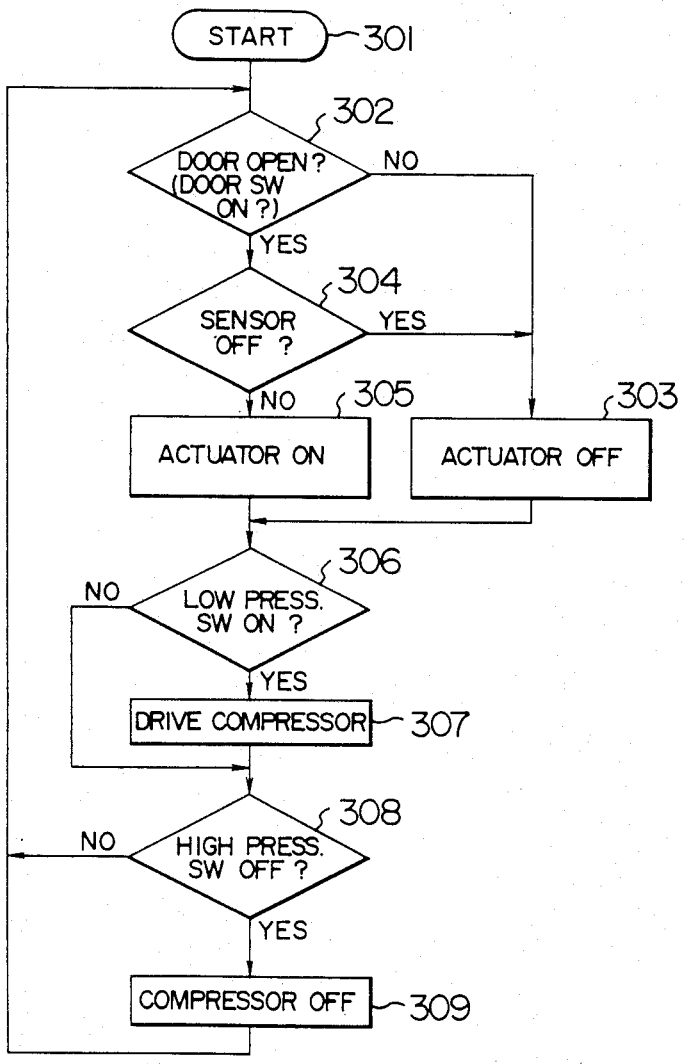
FIG. 6 is a flow chart of a control progarm of the microcomputer shown in FIG. 1.

Then the operation of the above mentioned embodiment will now be described referring a control program shown in FIG. 6.

When a key switch of the vehicle is switched on, the program starts (step 301) and the process proceeds to step 302.

At step 302, the signal from the door switch 9 is read and the opening condition of the door 30 is checked. If the door 30 is closed, the process proceeds to step 303 where the microcomputer 3 outputs a command to the control valve 5 so as to disenergize a solenoid thereof. When the control valve 5 is disenergized, the conduit 10*c* of the cylinder 40 is communicated with the atmosphere and the piston 45 is urged in a direction of arrow P by the spring 44. Accordingly, the holder member 48 with the friction member 47, which is carried by the piston 45, is set apart from the check arm 38, so that the door 30 can be free to open or close.

Meanwhile, at step 302, when it is decided that the door 30 is open, the process proceeds to step 304 where it is checked whether or not the operator has an intention of opening or closing the door. When the operator touches on the sensor 1 so as to open or close the door, the resistance of the pressure sensitive rubber sheet 50 is reduced. Accordingly, the comparison circuit 2 outputs the "H" signal and then it is decided that the operator has an intention of opening or closing the door 30. Thereafter, the process proceeds to step 303 and then the door 30 can be free to open or close in the same manner described above.

If the operator releases his hand from the sensor 1 during door opening operation, the comparison circuit 2 outputs the "L" signal and then the process proceeds to step 305 where the solenoid of the control valve 5 is energized. Accordingly, the compressed air is introduced into the working chamber 49 of the cylinder 40 through the control valve 5. The introduced compressed air in the working chamber urges the piston 45 in an inverse direction of arrow P against the spring force of the spring 44 (FIG. 4). Accordingly the check arm 38 is tightly clamped by a pair of friction members 47, 47 and then the door 30 is held in an instant opening degree. Since the check arm 38 is clamped by the friction members 47, 47 according to the above mentioned embodiment, the door can be smoothly stopped and held with less shock even when the door is moving, compared with the mechanical lock mechanism.

After prosecution in step 303 or 305, the process proceeds to step 306 to 309 so that the interior pressure in the tank 6 is maintained within a predetermined range. At step 306, it is checked whether or not the low pressure switch 7*b* is opened. When the low pressure switch 7*b* is closed, i.e. the interior pressure in the tank 6 is lower than $3.9\times10^5$ Pa, the process proceeds to step 307 where the compressor 8 is further driven so as to increase the air pressure. Thereafter, the process proceeds to step 308. When the interior pressure in the tank 6 is higher than $3.9\times10^5$ Pa, the process also proceeds to step 308.

At step 308, it is checked whether or not the high pressure switch 7a is opened, i.e. the interior pressure in the tank 6 is higher than $4.9\times10^5$ Pa. If it is "YES", it is decided that the interior pressure in the tank 6 is higher than predetermined value, so that the process proceeds to step 309. At step 309, the compressor is stopped and then the process returns back to the step 302. To the contrary, if it is "NO", it is decided that the interior pressure in the tank 6 is lower than $4.9\times10^5$ Pa and is maintained within a predetermined range, so that the process returns back to step 302. Accordingly, the interior pressure in the tank 6 is always maintained in the range of $3.9\text{–}4.9\times10^5$ Pa.

The present invention is not limited to the above embodiment, but it may be modified as follows.

(1) Instead of touch sensor, an on-off type switch may be applicable to the door knob 30*a* and so on.

Referring to the actuator, it is most preferable to use an actuator driven by the compressed air, as described above. However, another type of actuator may be applicable, e.g. an actuator driven by the negative pressure, a hydraulic actuator or an actuator driven by an electric motor.

Figure 7:
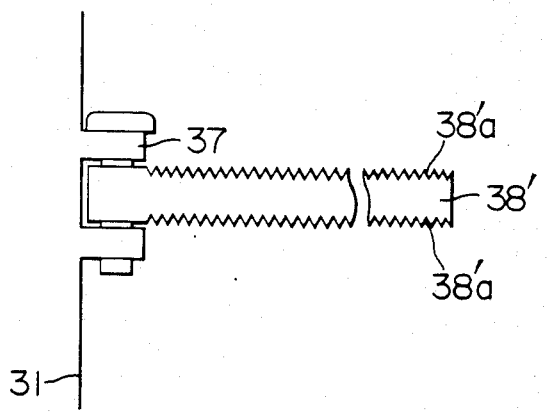
FIG. 7 is a side view showing a check arm in another embodiment of the present invention.

(2) The frictional force between the check arm 38 and the friction member 47 is one of the factors in the effectiveness of the invention. The greater the frictional force becomes, the greater the forces for holding and stopping the door become. In view of this, the check arm 38' may be provided on opposite end surfaces thereof with serrations 38'*a*, 38'*a* as shown in FIG. 7 so as to increase the frictional force between the check arm 38' and the friction member 47.

(3) The pipe-shaped check arm is also applicable to the invention, instead of the plate-shaped check arm 38. In this case, the friction member 47 must be provided with a complementary groove.

(4) The member which is adapted to engage with the friction member, e.g. the check arm may be mounted on the outside of the door. Also, the friction member and driving member may be disposed outside of the door.

What is claimed is:

1. An apparatus for holding a motor vehicle door at a desired opening degree thereof comprising:

sensor means provided on the door for detecting whether or not said sensor means is touched by an operator;

an engaging member pivotally mounted at one end thereof onto a vehicle body, said member being relatively reciprocatable to the door;

a friction member provided on the door;

driving means for urging said friction member against said engaging member to generate a friction force therebetween for permitting no relative movement between said engaging member and said friction member, the friction member being connected with the door in such a manner that, when the driving means urges the friction member into engagement with said engaging member, there can be no relative movement between the door and the vehicle body, said driving means being driven by pneumatic power;

means for selectively supplying said pneumatic power to said driving means, said supply means being operated by an electric signal command; and control means, coupled to said sensor, for providing commands to said supplying means said control means providing commands to said supplying means to make it inoperative when said sensor is being touched by the operator, said control means providing commands to operate said supplying means when said sensor is not being touched by the operator.

2. An apparatus according to claim 1, wherein said engaging member is capable of relatively reciprocating within an interior of the door, and wherein said friction member and said driving means are disposed within the interior of the door.

3. An apparatus according to claim 1, wherein said supplying means comprises:

an electric compressor for compressing air;

air passages for making said compressor communicate with said driving means; and switching valve means disposed in said air passages, said switching valve means being operated by the command from said control means for selectively supply the compressed air from said compressor to said driving means.

4. An apparatus according to claim 1, wherein said engaging member is provided at a portion thereof with serrations, which engages with said friction member upon operation of said apparatus.

5. An apparatus according to claim 1, wherein said apparatus further comprises a door switch for detecting whether or not the door is close, and wherein said control means includes means for delivering commands to said supplying means to make it inoperative upon receipt of a signal from said door switch indicating that the door is closed.

6. An apparatus for holding a motor vehicle door at a desired opening degree thereof comprising:

sensor means provided on the door for detecting whether or not said sensor means is touched by an operator;

an engaging member pivotally mounted at one end thereof onto a vehicle body, said member being relatively reciprocatable to the door;

a friction member provided on the door;

driving means for urging said friction member against said engaging member to generate a friction force therebetween for permitting no relative movement between said engaging member and said friction member, the friction member being connected with the door in such a manner that, when the driving means urges the friction member into engagement with said engaging member, there can be no relative movement between the door and the vehicle body, said driving means being driven by hydraulic power;

means for selectively supplying said hydraulic power to said driving means, said supply means being operated by an electric signal command; and control means, coupled to said sensor, for providing commands to said supplying means, said control means providing commands to said supplying means to make it inoperative when said sensor is being touched by the operator, said control means providing commands to operate said supplying means when said sensor is not being touched by the operator.

7. An apparatus for holding a door of a motor vehicle at a desired opening degree thereof comprising:

sensor means provided on said door for detecting whether or not said sensor means is being touched by an operator;

an engaging member pivotally mounted at one end thereof to a body of said vehicle, said engaging member being relatively reciprocatable to the door;

braking means provided around said engaging member for braking the reciprocation of said engaging member to hold the door at the desired opening degree thereof; and control means for receiving signals from said sensor means and providing commands to said braking means, said control means providing a command to said braking means to make it inoperative when said sensor is being touched by the operator, and providing a command to said braking means to operate when said sensor is not being touched by the operator.

8. An apparatus according to claim 7, wherein said braking means comprises:

a resistance member provided on the door;

fluid operable driving means for actuating said resistance member against said engaging member; and means for providing fluid power to said driving means responsive to a command from said control means.

9. An apparatus according to claim 7, further comprising a door switch for detecting whether or not said door is closed, and wherein said control means includes means for controlling said breaking means to make it inoperative when said door is closed.

10. An apparatus according to claim 7, wherein said engaging member has a surface portion thereof that is serrated.

11. An apparatus according to claim 7 wherein said breaking means comprises a friction member operable to grasp said engaging member to prevent relative movement therebetween.

12. An apparatus according to claim 7, wherein said friction member is fluid operated.

* * * * *